US005916045A

United States Patent [19]

Busch

[11] Patent Number: 5,916,045

[45] Date of Patent: Jun. 29, 1999

[54] BATTING TEE

[76] Inventor: Thomas S. Busch, 5425 W. 101st Ter., Overland Park, Kans. 66207

[21] Appl. No.: 08/901,406

[22] Filed: Jul. 28, 1997

[51] Int. Cl.[6] ..... A63B 69/40

[52] U.S. Cl. ..... 473/417

[58] Field of Search ..... 473/417, 423, 473/453, 397

[56] References Cited

U.S. PATENT DOCUMENTS

| | | | |
|---|---|---|---|
| 3,139,282 | 6/1964 | Lande | 473/417 |
| 3,877,697 | 4/1975 | Lersch | 473/417 |
| 4,819,937 | 4/1989 | Gordon | 473/417 |
| 5,004,234 | 4/1991 | Hollis | 473/417 |
| 5,388,823 | 2/1995 | Prieto | 473/417 |
| 5,536,004 | 7/1996 | Wiseman | 473/417 |
| 5,556,091 | 9/1996 | Lin | 473/417 |

*Primary Examiner*—Theatrice Brown
*Attorney, Agent, or Firm*—Mark E. Brown; Litman, Kraai & Brown LLC

[57] ABSTRACT

A multiple-adjustable batting tee includes base and tube assemblies. The base assembly includes a base plate and a rotating plate. The rotating plate is rotatably mounted on the base plate by an axle subassembly. The tube assembly includes telescopically interconnected first and second tubes. The first tube is concentrically mounted on the rotating plate.

3 Claims, 5 Drawing Sheets

BATTING TEE

BACKGROUND OF THE INVENTION

1. Field of the Invention

The present invention relates generally to equipment for sports training and play, and in particular to a multi-adjustable batting tee.

2. Description of the Related Art

Sports which involve batting are quite popular and include baseball, softball and tee ball. The object of the batter in such sports is generally to bat the ball into the field of play with considerable force. The ball can either be pitched to a batter or, in the case of tee ball, supported in the batter's strike zone by a tee structure. Prior art batting tees generally include base and tube assemblies, with the tube assemblies having lower ends connected to the base assemblies and upper ends for supporting a ball in the approximate area of the player's strike zone. The base assembly is usually a home plate sized piece of solid rubber or plastic. Certain tees can be rotated to a series of different positions on the base through a pin and hole system, rotating goose-neck shaped tee or by placement in multi-position tee holes in the base assembly. The performance of many prior art stationary and rotating batting tees is limited by the placement of their tee stems. Stationary tees restrict the ball to a single location over the center of the base or home plate. This restriction forces the batter to improperly position his or her feet in relation to home plate and to reposition himself or herself every time he or she wants to change the direction of ball flight. This limitation encourages poor stance and swing mechanics. Many prior art rotating tees limit tee stem placement to a few locations over home plate. By restricting tee locations to positions on home plate, current tees do not allow for batters to hit balls in front of home plate where optimum force can be applied.

The present invention addresses these disadvantages associated with prior art batting tees.

SUMMARY OF THE INVENTION

In the practice of the present invention, a batting tee is provided which includes a base assembly having a base plate and a rotating plate. The rotating plate is rotatably mounted on the base plate for rotation about a pivotal axis. A tube assembly includes first and second tubes telescopically interconnected for height adjustment. The first tube has a lower end with a hub fitted therein for receiving a tube assembly mounting bolt which is anchored in the rotating plate adjacent to a perimeter thereof. The second tube includes an upper end for receiving a ball in multi-adjustable batting position. The base plate has a hole near its pointed end through which a metal spike is inserted which secures it to the ground.

OBJECTS AND ADVANTAGES OF THE INVENTION

The principal objects and advantages of the present invention include: providing a batting tee; providing such a batting tee which is height adjustable; providing such a batting tee which accommodates 360° rotational adjustment; providing such a batting tee which provides multiple positions of a ball with respect to a home plate, approximately half of which can be positioned in front of home plate; providing such a batting tee which can position a ball at various locations which can teach a batter to pull inside pitches and drive outside pitches; providing such a batting tee which is well adapted for use in playing tee ball; providing such a batting tee which is well adapted for use in batting practice activities; providing such a batting tee which can be quickly adjusted to maintain the expeditious playing of a game; providing such a batting tee which facilitates both game play and batting training; providing such a batting tee which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
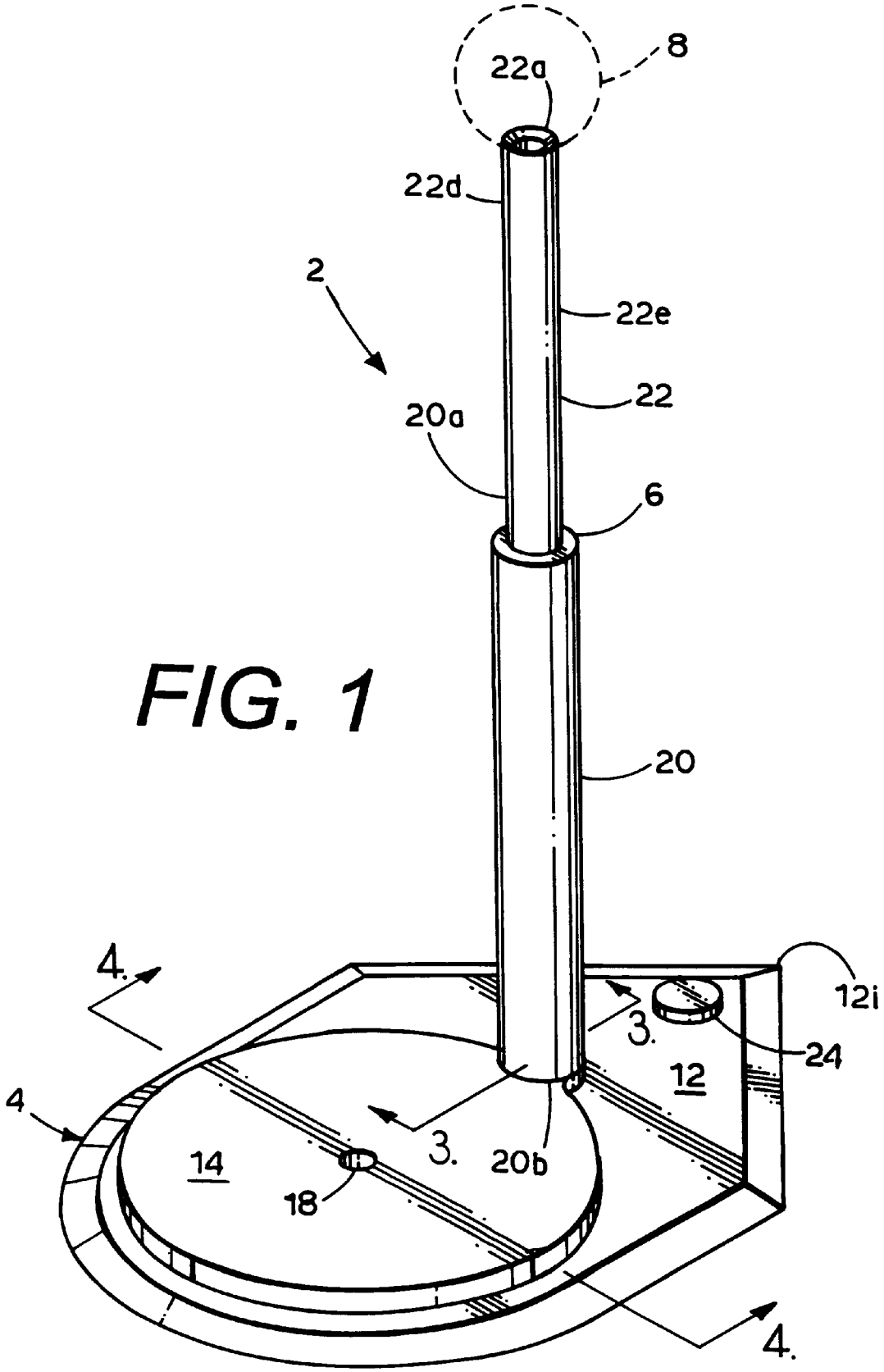
FIG. 1 is an upper perspective view of a batting tee embodying the present invention.
Figure 2:
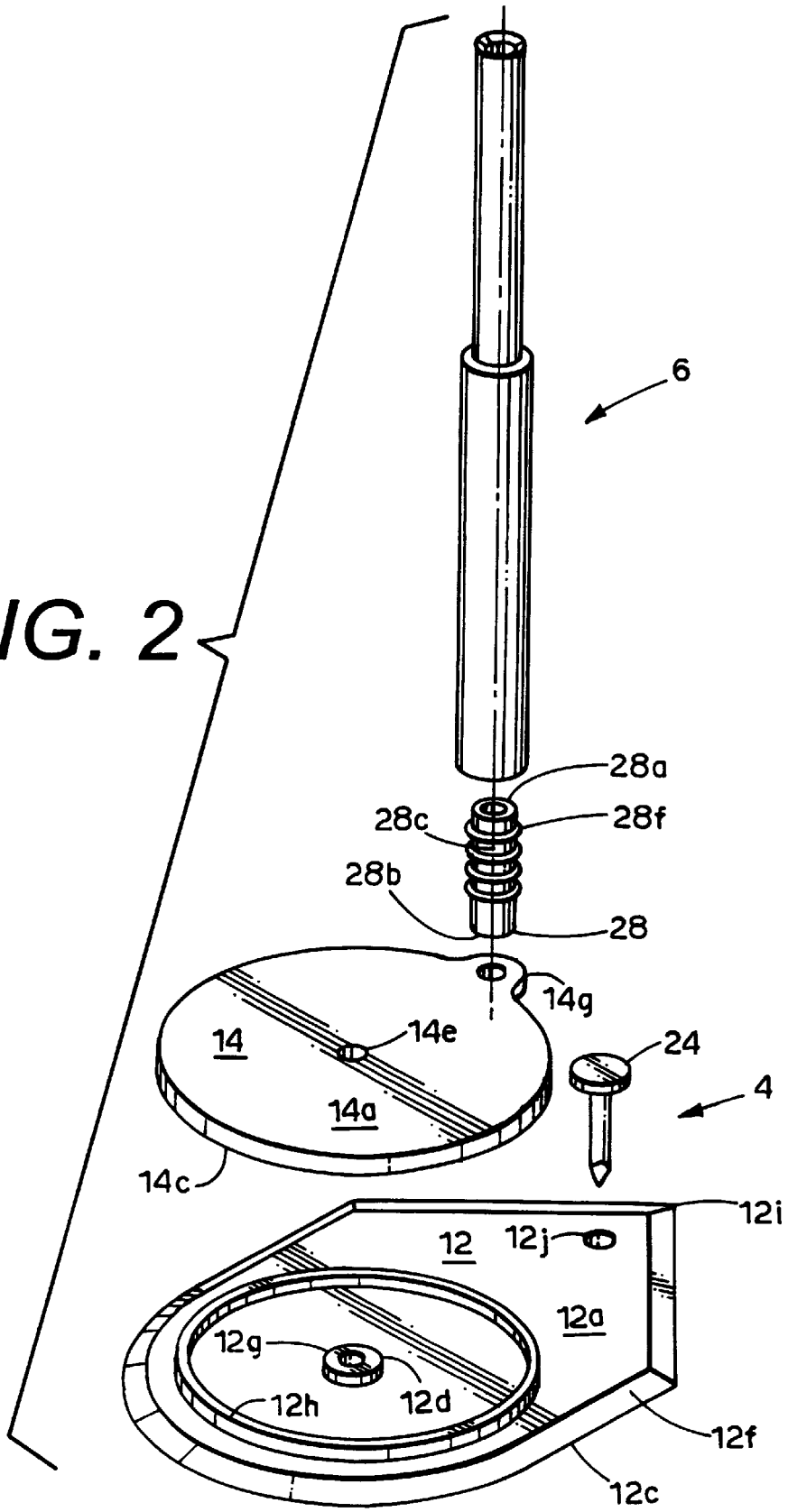
FIG. 2 is an exploded, upper perspective view of the batting tee.
Figure 3:
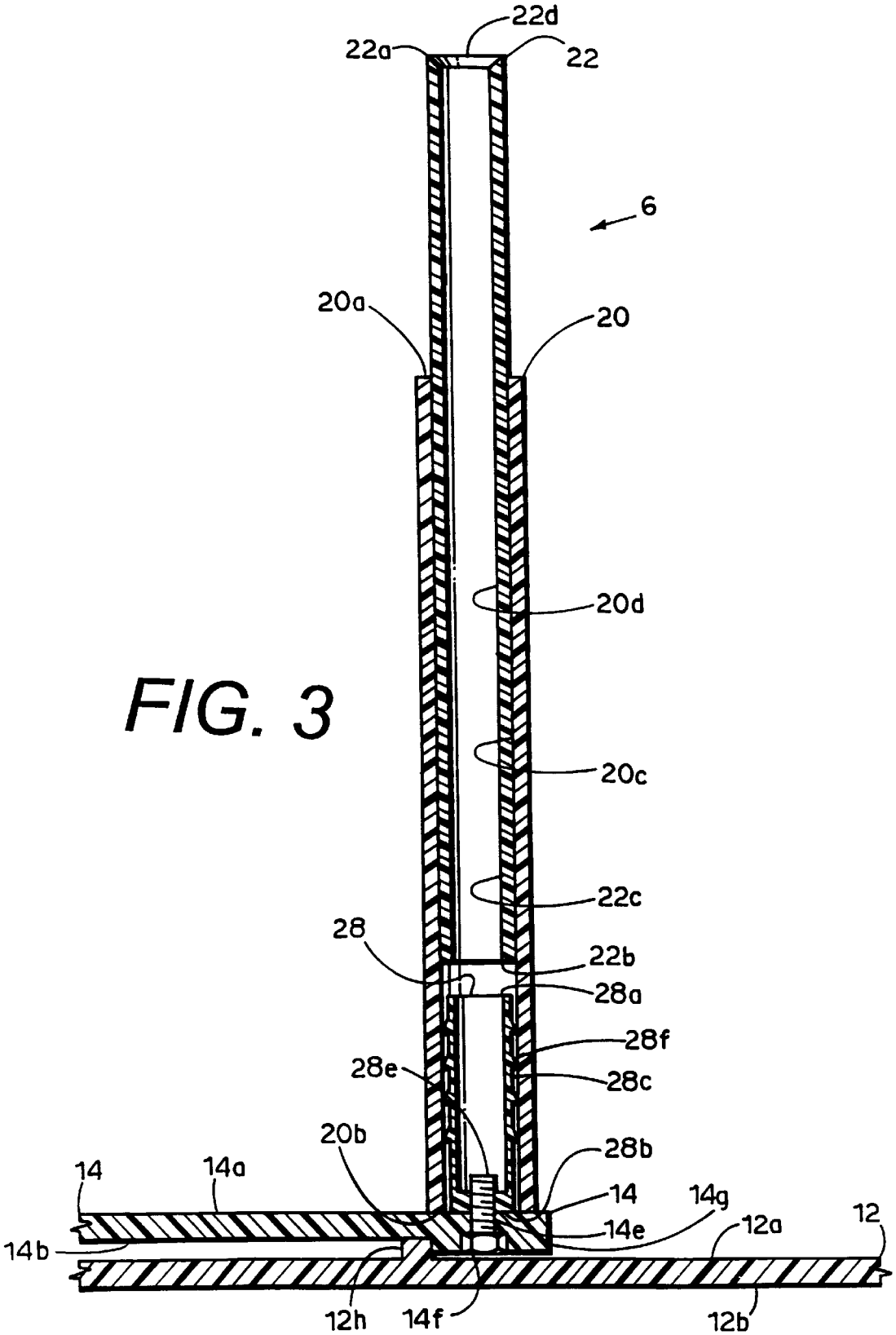
FIG. 3 is an enlarged, vertical, cross-sectional view of the batting tee, taken generally along line 3—3 in FIG. 1.
Figure 4:
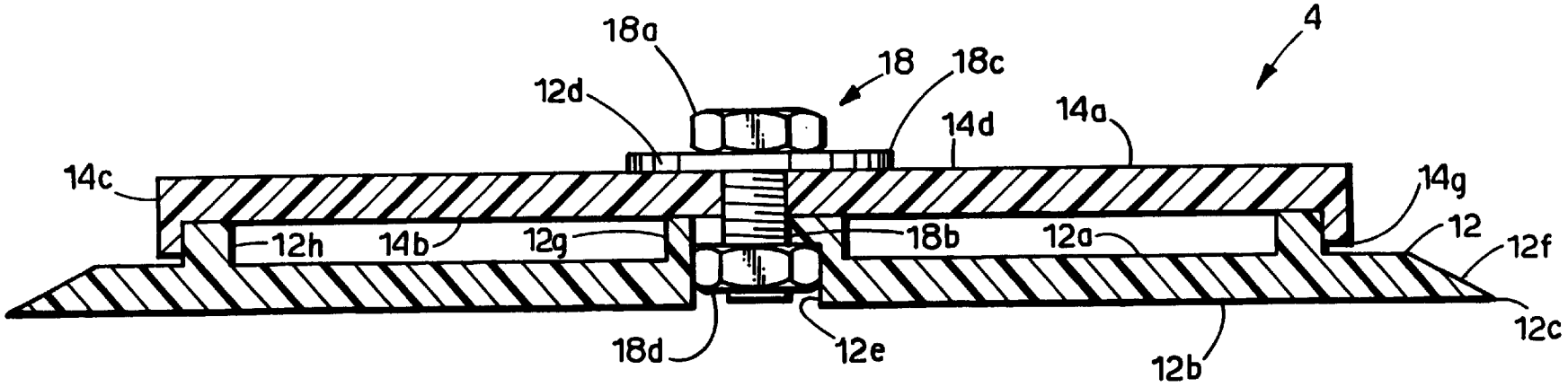
FIG. 4 is a vertical, cross-sectional view of a base assembly at the batting tee, taken generally along line 4—4 in FIG. 1.
Figure 8:
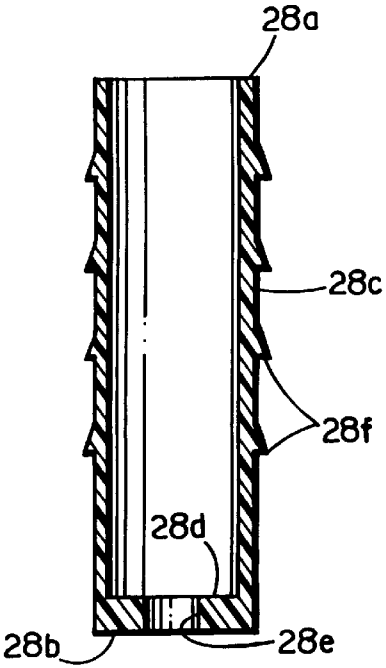
FIG. 8 is a vertical, cross-sectional view of the hub, taken generally along line 8—8 of FIG. 7.
Figure 6:
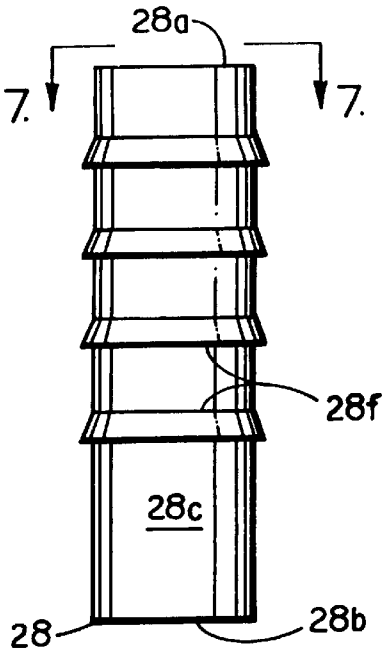
FIG. 6 is a side elevational view of the hub.
Figure 7:
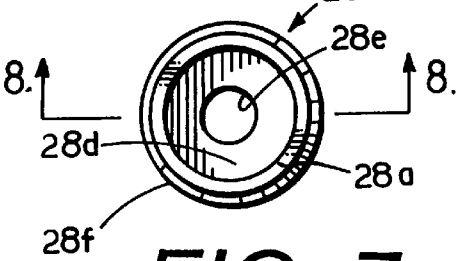
FIG. 7 is a top plan view of the hub, taken generally along line 7—7 in FIG. 6.
Figure 5:
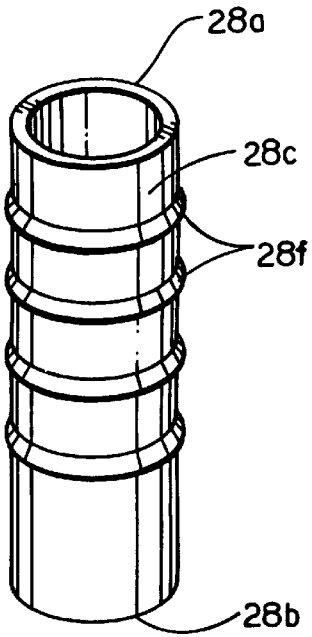
FIG. 5 is an upper, perspective view of a hub of the batting tee.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a batting tee embodying the present invention and generally comprising a base assembly 4 and a tube assembly 6. The batting tee 2 is designed to support a ball 8 at a multi-adjustable position with respect to a batter standing adjacent to the batting tee 2.

II. Base Assembly 4

The base assembly 4 includes a base plate 12 with upper and lower surfaces 12*a,b* and a base plate perimeter 12*c*. The base plate perimeter 12*c* has a five-sided configuration, which generally corresponds to the configuration of a home plate in baseball and softball.

The base plate perimeter 12*c* can be suitably beveled at 12*f*. The base plate 12 includes an axle bolt boss 12*g* with a concentric axle bolt receiver 12*d* extending between and open at the base plate upper and lower surfaces 12*a,b*. The base plate axle bolt receiver 12*d* includes a nut inset section 12*e* adjacent to the lower surface 12*b*. A concentric ring 12*h* projects upwardly at the base plate upper surface 12*a*. The base plate has a hole 12*j* in it near its pointed front end 12*i* through which a metal spike 24 is inserted which can secure it to the ground.

The base assembly 4 also includes a rotating plate 14 with upper and lower surfaces 14*a,b* and a generally circular rotating plate perimeter 14*c* with a downwardly-depending circular flange 14*g*. The rotating plate includes a rotating plate axle bolt receiver 14*d* which is generally concentric with the perimeter 14*c*. The rotating plate includes a tube assembly mounting boss 14*d* projecting from its perimeter 14*c* and including a tube assembly mounting bolt receiver 14*e* with an inset section 14*f* for receiving the head 16*a* of a tube assembly mounting bolt 16.

The base and rotating plates 12, 14 are rotatably secured together by an axle bolt subassembly 18 including an axle bolt 18*a* with a threaded shank 18*b* extending through a washer 18*c* and through the aligned axle bolt receivers 12*d*, 14*d* and threadably secured in an axle nut 18*d* captured in the nut inset section 12*e*.

III. Tube Assembly 6

A tube assembly 6 includes a first tube 20 with upper and lower ends 20*a,b* and a first tube bore 20*c* extending between and open at the first tube ends 20*a,b*. The first tube bore 20*c* defines a first tube inner surface 20*d*. A second tube 22 includes upper and lower ends 22*a,b* and a second tube bore 22*c* extending between and open at the second tube ends 22*a,b*. The second tube upper end 22*b* is beveled at 22*d* inwardly and downwardly to receive the ball 8.

The first and second tubes 20, 22 are telescopically interconnected with a friction fit therebetween whereby the overall length of the tube assembly 6 can be telescopically adjusted, but will maintain the ball 8 at a predetermined height. The frictional coefficient of the material comprising the tubes 20, 22 and the interference fit therebetween are preferably sufficient to maintain the second tube 22 in an extended position while supporting a ball during batting activities. However, it is also preferable to permit manual length adjustment of the tube assembly 6.

A generally cylindrical hub 28 is mounted in the first tube lower end 20*b* and includes hub upper and lower ends 28*a,b*; a hub outer surface 28*c* and a hub bottom 28*d* enclosing the hub lower end 28*b* and including a concentric, threaded receiver 28*e* for threadably receiving the tube assembly mounting bolt 16. The hub 28 has annular ridges 28*f* projecting outwardly from its outer surface 28*c* and having sawtooth-shaped cross-sectional configurations. The hub 28 is retained in the first tube bore 20*c* by an interference fit between the hub ridges 28*f* and the first tube bore inner surface 20*d*. The hub 28, the hub ridges 28*e* and the first tube bore 20*c* are preferably all sized to effect a relatively secure mounting of the hub 28 which resists pullout from the first tube bore 20*c*.

IV. Operation

In operation, the batting tee 2 is adapted for use as a batting training aid or tee ball stand for tee ball play. By rotating the rotating plate 14, the ball 8 can be placed at various locations within a player's strike zone (approximately half of which can be in front of the home plate and approximately half of which can be over the home plate). Since the rotating plate 14 has a range of motion including a full 360° circle, the range of possible locations within a horizontal plane defined by the circle in which the ball rotates is virtually unlimited. Thus, the ball can be placed close to the player (i.e., towards the inside of the strike zone) or away from the player (i.e., towards the outside of the strike zone). The ball can also be placed relatively far forward or relatively far back within the strike zone, depending upon the player's preference. By properly positioning the player and the ball, the batting performances of players can be significantly improved.

Additionally, the batting tee 2 provides for vertical adjustment for locating the ball at a desired height. The second tube 22 can be provided with suitable markings 22*e* to identify predetermined locations corresponding to predetermined ball heights. Thus, players can readily reposition the ball 8 by telescoping the first and second tubes 20, 22 with respect to each other.

The tube and base assemblies 4, 6 preferably primarily comprise a resilient, flexible plastic material to accommodate impact absorption associated with bats and player contact. For example, when the ball 8 is struck the tube assembly 6 typically bends or flexes in the direction of the swing and rebounds to an upright position. Moreover, sufficient flexibility is required to accommodate the impact of an underswing.

It is to be understood that while certain forms of the present invention have been illustrated and described herein, it is not to be limited to the specific forms or arrangement of parts described and shown.

What is claimed and desired to be secured by Letters Patent is as follows:

1. A batting tee, which comprises:

(a) a base assembly including:

(1) a base plate with base plate upper and lower surfaces and a base plate perimeter;

(2) said base plate having a boss projecting upwardly at the upper surface thereof;

(3) said base plate having a ring projecting upwardly at the upper surface thereof, said ring being generally concentric with said boss;

(4) said base plate having a base plate axle bolt receiver extending between and open at said base plate upper and lower surfaces and extending through said boss, said base plate axle bolt receiver having a nut inset section open at said base plate lower surface;

(5) a rotating plate including upper and lower surfaces and a generally circular rotating plate perimeter;

(6) said rotating plate having a generally circular flange depending downwardly from said rotating plate perimeter, said rotating plate flange generally encircling said base plate ring;

(7) said rotating plate having a tube assembly mounting bolt boss projecting radially outwardly from said rotating plate perimeter, said tube assembly mounting bolt boss having a tube assembly mounting bolt receiver extending between and open at said rotating plate upper and lower surfaces;

(8) said tube assembly mounting bolt receiver having a tube assembly mounting bolt head inset section open at said rotating plate lower surface;

(9) an axle bolt subassembly including an axle bolt with a threaded shank extending through said axle bolt receivers and mounting a washer on said rotating plate upper surface; and

(10) said axle bolt subassembly including an axle nut positioned in said axle nut inset section and threadably receiving said axle bolt shank; and (b) a tube assembly, which includes:

(1) upper and lower tube assembly ends;

(2) a first tube with a first tube lower end forming said tube assembly lower end, a first tube upper end and a first tube bore extending between and open at said first tube upper and lower ends;

(3) a second tube with a second tube upper end forming said tube assembly upper end, a lower end and a second tube bore extending between and open at said second tube upper and lower ends;

(4) said second tube upper ends being beveled inwardly and downwardly;

(5) said second tube being telescopically, slidably received within said first tube bore in a frictional, interference fit therein;

(6) a hub having a generally cylindrical configuration with upper and lower hub ends, a circular hub bottom mounted in said hub lower end;

(7) a concentric, threaded, tube assembly mounting bolt receiver in said hub bottom;

(8) said hub having a plurality of external annular ridges;

(9) said hub being received in said first tube bore adjacent to said first tube lower end with said hub ridges engaging said first tube within said first tube bore in a frictional interference fit; and

(10) a tube assembly mounting bolt including a head positioned within said tube assembly mounting bolt inset section and a threaded shank threadably received in said hub bottom threaded receiver.

2. The batting tee according to claim 1, which includes:

(a) said base plate having a five-sided configuration.

3. The batting tee according to claim 1, which includes:

(a) said first and second tubes comprising a resilient material.

* * * * *